US008425180B2

(12) United States Patent
Sears et al.

(10) Patent No.: US 8,425,180 B2
(45) Date of Patent: Apr. 23, 2013

(54) SYSTEMS AND APPARATUS RELATING TO STEAM TURBINE OPERATION

(75) Inventors: Kristan B. Sears, Schenectady, NY (US); Michael J. Bowman, Niskayuna, NY (US); John R. Powers, Scotia, NY (US)

(73) Assignee: General Electric Company, Schenectady, NY (US)

( * ) Notice: Subject to any disclaimer, the term of this patent is extended or adjusted under 35 U.S.C. 154(b) by 625 days.

(21) Appl. No.: 12/650,848

(22) Filed: Dec. 31, 2009

(65) Prior Publication Data

US 2011/0158790 A1 Jun. 30, 2011

(51) Int. Cl.
*F01D 3/04* (2006.01)

(52) U.S. Cl.
USPC ..... 415/107; 415/104; 415/105

(58) Field of Classification Search ..... 415/104, 415/105, 107, 144
See application file for complete search history.

(56) References Cited

U.S. PATENT DOCUMENTS 3,614,255 A * 10/1971 Rooney ..... 415/100
7,607,304 B2 10/2009 Kjaer
2006/0140747 A1* 6/2006 Vandervort et al. ..... 415/1

FOREIGN PATENT DOCUMENTS

DE 19953123 * 5/2001
GB 1105658 * 3/1968

OTHER PUBLICATIONS

Ruth et al., Turbo assembly for steam power plant has high and mean pressure turbines on common shaft each with thrust compensating pistons where mean pressure piston is at outlet side on high pressure turbine to be fed direct with high pressure steam, May 10, 2001, Abstract of DE 199 53 123.*

* cited by examiner

*Primary Examiner* — Edward Look
*Assistant Examiner* — Liam McDowell
(74) *Attorney, Agent, or Firm* — Mark E. Henderson; Ernest G. Cusick; Frank A. Landgraff

(57) ABSTRACT

A steam turbine power plant that includes a first steam turbine, the steam turbine power plant including: a thrust piston operably connected to the first steam turbine via a shaft; and means for applying a supply of pressurized steam against the thrust piston such that the thrust piston applies a desired thrust force to the shaft. The desired thrust force may comprise a thrust force that partially balances a thrust force the first steam turbine applies to the shaft during operation.

16 Claims, 3 Drawing Sheets

SYSTEMS AND APPARATUS RELATING TO STEAM TURBINE OPERATION

BACKGROUND OF THE INVENTION

This present application relates generally to methods, systems, and/or apparatus for improving the operation of steam turbine engines. More specifically, but not by way of limitation, the present application relates to improved methods, systems, and/or apparatus pertaining to the operation of steam turbines with 3-flow low pressure turbines.

As one of ordinary skill in the art will appreciate, steam turbine plants may be constructed with a rotor train that, via a common shaft, connects multiple turbines that operate at varying pressure levels. Typically, each of these turbines is paired with another turbine so that the axial thrust force (or "thrust") being exerted on the shaft by each may be balanced by another. For example, a steam turbine plant may include a high-pressure turbine that is paired with an intermediate-pressure turbine. During operation, these turbines may be configured so that the thrust force each applies to the shaft is offset (or substantially offset) by the thrust the other applies. In addition, steam turbine plants often have two low-pressure turbines that are paired with each other in the same manner, i.e., so that the thrust each applies to the shaft balances the thrust of the other.

In some cases, however, the thrust forces applied across a rotor train having a common shaft cannot be balanced by pairing turbines. It will be understood that, in such situations, large, expensive thrust bearings generally are required to provide the counteracting forces so that thrust balance is achieved. In some applications, having an odd number of turbines would be advantageous, particularly where one of the turbines could be activated and deactivated depending on load requirements. In this case, the odd number of turbines and/or the fact that one is operated only at peak load periods means thrust balancing would be impossible by simply pairing the turbines to offset similar thrust forces. This system, instead, would have to include a sizable thrust bearing to counteract the force of generated by the part-time turbine when it operated. This solution, however, is not desirable because the cost of constructing and maintaining the thrust bearing is considerable, a fact that is even less palatable considering the thrust bearing is only needed on a pan-time basis, i.e., when the part-time turbine is activated.

As a result, there is a need for improved systems and/or apparatus for balancing rotor thrust in changing operating conditions and, for rotor trains that are difficult to balance because of the varying turbine size and number, particularly where the improvements are cost-effective and simple in both construction and operation.

BRIEF DESCRIPTION OF THE INVENTION

The present application thus describes a steam turbine power plant that includes a first steam turbine, the steam turbine power plant including: a thrust piston operably connected to the first steam turbine via a shaft; and means for applying a supply of pressurized steam against the thrust piston such that the thrust piston applies a desired thrust force to the shaft. The desired thrust force may comprise a thrust force that partially balances a thrust force the first steam turbine applies to the shaft during operation.

The present application further describes: in a steam turbine power plant that includes a rotor train comprising a high-pressure turbine, an intermediate-pressure turbine, and three low-pressure turbines, wherein the three low-pressure turbine include two that comprise a dual-flow low-pressure turbine and a single-flow low-pressure turbine; wherein the high-pressure turbine and the intermediate-pressure turbine are configured such that each substantially balances the thrust force of the other, and wherein the two low-pressure turbines of the dual-flow low-pressure turbine are configured such that each substantially balances the thrust force of the other; and wherein means for extraction supply high-pressured steam from the high-pressure turbine to a cavity disposed forward of the single-flow low-pressure turbine; and wherein the cavity, in the direction toward the single-flow low pressure turbine, is substantially bound by stationary structure that surrounds a shaft of the rotor train, a thrust piston connected to the shaft. The cavity, in the direction away from the single-flow low pressure turbine, may be substantially bound by the thrust piston. The thrust piston may be configured to counteract a desired amount of a thrust force generated by the single-flow low-pressure turbine during operation.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

As an initial matter, to communicate clearly the invention of the current application, it may be necessary to select terminology that refers to and describes certain parts or machine components of a turbine engine. Whenever possible, common industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often a particular component may be referred to using several different terms. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component, as provided herein.

In addition, several descriptive terms may be used regularly herein, and it may be helpful to define these terms at this point. Given their usage herein, these terms and definitions are as follows. "Downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The terms "trailing" and "leading" generally refers relative position in relation to the direction of rotation for rotating parts. As such, the "leading edge" of a rotating part is the front or forward edge given the direction that the part is rotating and, the "trailing edge" of a rotating part is the aft or rearward edge given the direction that the part is rotating. The term "radial" refers to movement or position perpendicular to an axis. It is often required to described parts that are at differing radial positions with regard to an axis. In this case, if a first component resides closer to the axis than a second component, it may be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis.

Figure 1:
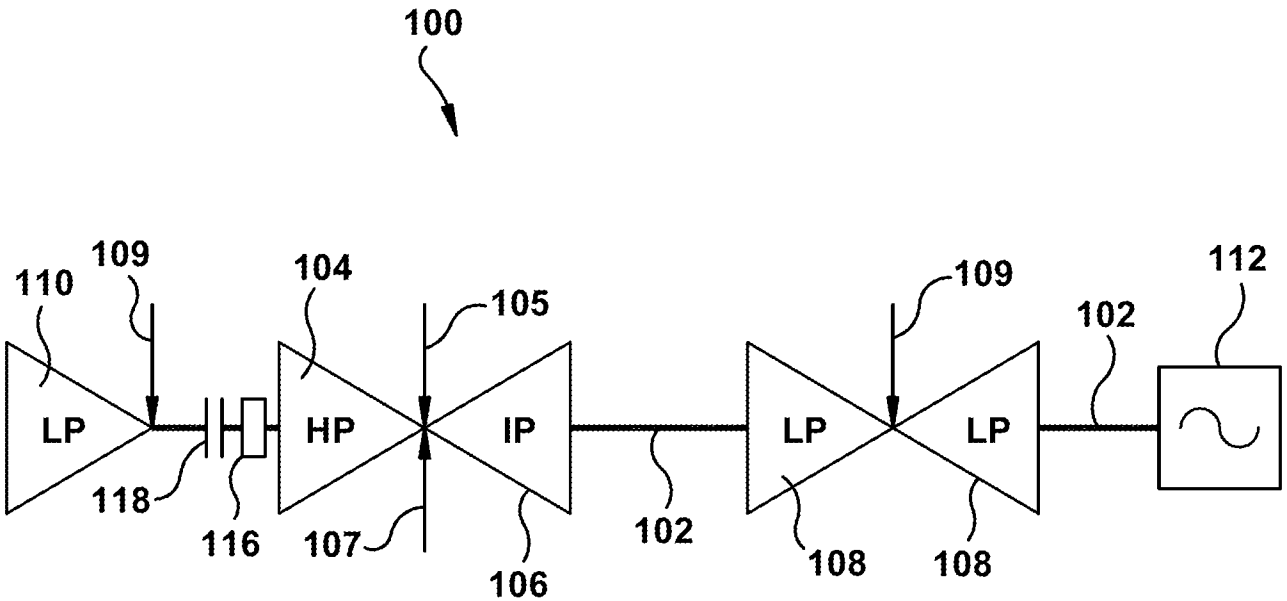
Figure 1 (Prior Art)
FIG. 1 is a schematic representation of an exemplary steam turbine power plant according to conventional design.

Referring to the figures, FIG. 1 illustrates a schematic representation of a steam turbine power plant 100 according to a possible conventional layout. It will be appreciated that the steam turbine power plant 100 may include a rotor train that includes several turbines or turbine sections, which, as stated, may be referred to given the relative pressure level of the steam that is directed through each. As shown, connected via a common rotor or shaft 102, the steam turbine power plant 100 may include a high-pressure turbine ("HP turbine") 104, which includes a high-pressure steam feed 105, an intermediate-pressure turbine ("IP turbine") 106, which includes an intermediate-pressure steam feed 107, and three different low-pressure turbines, two of which are part of a dual-flow low-pressure turbine ("dual flow LP turbines") 108, which includes a low-pressure steam feed 109, and a single-flow low-pressure turbine ("single-flow LP turbine") 110, which also includes a low-pressure steam feed 109.

Though not shown, it will be understood that the steam turbine power plant 100 includes a steam source or boiler (not shown), which provides the supply of pressurized steam that is delivered via the steam feeds 105, 107, 109 to the turbine sections 104, 106, 108, 110. As one of ordinary skill in the art will appreciate, various supply configurations and systems are possible for supplying the steam feeds. For example, steam supply systems may be configured to include one or more direct or indirect connections made between the boiler and the various turbine sections; or, for example, one or more connections may be made between the output or exhaust of one of the higher pressure turbine sections to the steam feed of one of the lower pressure turbine sections; or, some combination of either of those systems may be used. The system may further include one or more re-heaters, pre-heaters, and/or other conventional components and systems. In addition, the shaft 102 is connected to a generator 112 where the mechanical energy of the rotating shaft is converted into electricity.

The steam turbine power plant 100 is configured, as shown, such that the HP turbine 104 is paired with the IP turbine 106. It will be understood that the HP turbine 104 and the IP turbine 106 may be configured such that, during operation, the thrust force generated by and asserted to the shaft 102 is offset (or, at least, partially offset) by the thrust the other applies to the shaft 102. In addition, as shown in FIG. 1, the dual-flow LP turbines 108 may be paired with each other in the same manner, i.e., so that the thrust each applies to the shaft balances the thrust of the other.

However, it will be appreciated that a pairing is not possible for the single-flow LP turbine 110 that is also included in FIG. 1. Nevertheless, when the single-flow LP turbine 110 is operating, it applies a considerable thrust force against the shaft 102 that must be accounted for or "balanced" in some manner. Confronted with this issue, conventional technology generally points toward the inclusion of a large thrust bearing 116. That is, a thrust bearing 116 may be located opposite of (and forward of) the single-flow LP turbine 110 to provide the axial support that is needed to counteract the thrust created when the single-flow LP turbine 110 is operating. Thrust bearings 116 are generally large, costly to construct and maintain, and have a negative effect on engine efficiency as they produce a drag to the rotation of the shaft 102. In addition, because of the large thrust force being balanced in this type of application, a particularly large thrust bearing would be required, which magnifies the negatives. For these reasons, this alternative is relatively unattractive, and one of the reasons an "extra" single flow LP turbine 110 is not used in power plant applications.

Still, it will be appreciated that having an unpaired single-flow LP turbine 110, as shown in FIG. 1, may be advantageous, particularly, if the single-flow LP turbine 110 can be engaged and disengage to address changing load demands. It will be understood that such a system would allow power plant operators greater flexibility in addressing different load demands. A conventional clutching mechanism or clutch 118 is shown in FIG. 1 that would allow for this type of operability, as the single-flow LP turbine 110 could be engaged by the clutch 11R when needed and disengaged when the load demands do not require it. In such a system, the thrust imbalance caused by the single-flow LP turbine 110, of course, would only need to be balanced by the thrust bearing 116 when the single-flow LP turbine 110 was engaged by the clutch 118, which likely means the costly, oversized thrust bearing 116 would only be required during peak demand periods, and rendered superfluous at all other times.

It will be appreciated that many other components and systems may be included in the steam turbine power plant 100, such as different heat sources (fossil fuel fired plants, geothermal, nuclear, etc.), boiler types, other steam turbines, other clutch mechanisms, additional shafts, gear assemblies, re-heat systems, pre-heat system's, valves, journal bearings, crossover pipes, gas turbines, etc. For the sake of simplicity and because these components are incidental to the function of the presently claimed system, these components are not shown. This is also the case for the steam turbine power plants depicted in FIGS. 2 and 3.

Figure 2:
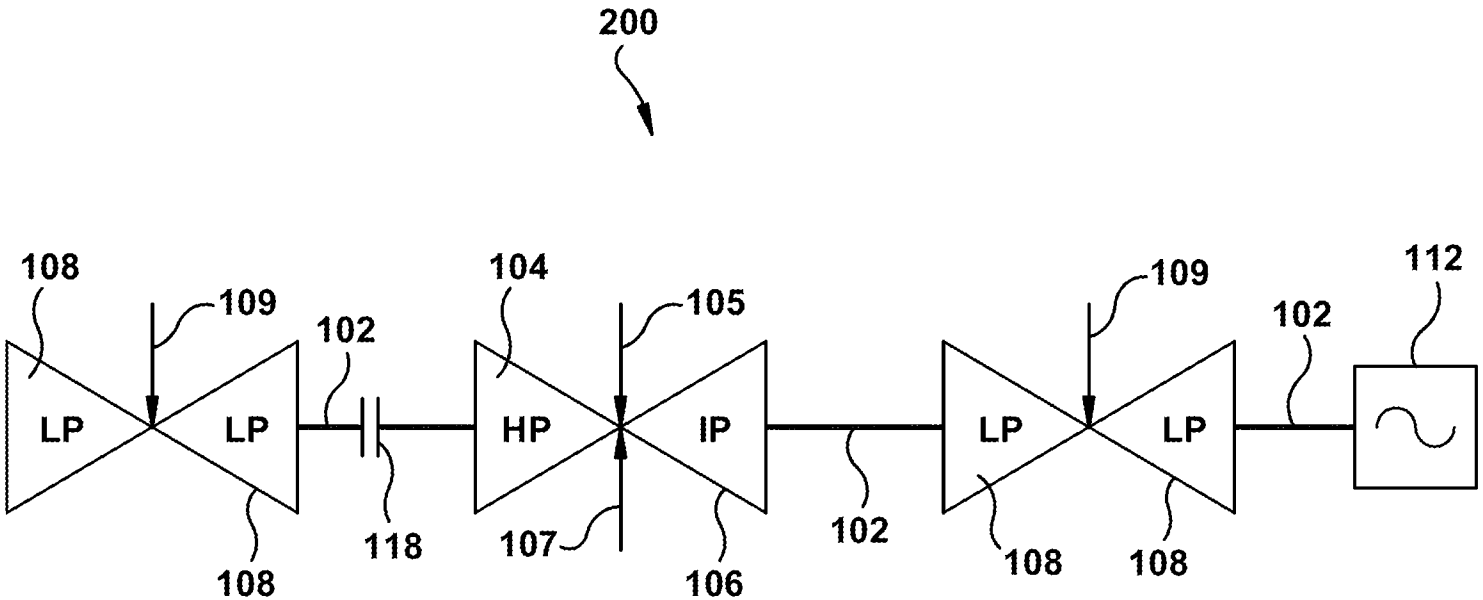
Figure 2 (Prior Art)
FIG. 2 is a schematic representation of another exemplary steam turbine power plant according to conventional design.

FIG. 2 provides a schematic representation of a steam turbine power plant 200 according to another possible conventional layout. It will be appreciated that, similar to the steam turbine power plant 100, the steam turbine power plant 200 includes several turbines that may be referenced given the pressure level of the steam that is directed through each, i.e., a HP turbine 104, which includes a high-pressure steam feed 105, an IP turbine 106, which includes an intermediate-pressure steam feed 107, and four LP turbines (each of which are paired in two dual-flow turbine 108 configurations), each of which includes a low-pressure steam feed 109. As with the power plant of FIG. 1, the steam turbine power plant 200 is configured such that the HP turbine 104 is paired with the IP turbine 106 such that the thrust of each substantially balances the other. The two sets of dual-flow LP turbines 108 are paired in the same manner, i.e., so that the thrust each applies to the shaft 102 balances the thrust of the other. As such, in this case, instead of an additional single-flow LP turbine 110 (as in FIG. 1), it may be said that two additional LP turbines 108 are included, which, via the clutch 118, may be used to address changing load demands by engaging and disengaging the dual-flow LP turbines 108 as necessary.

However, as one of ordinary skill in the art will appreciate, the power plant 200 in FIG. 2 is not does not allow for the same operational flexibility as the power plant of FIG. 1, as, in most applications, engaging two LP turbines 110 would overshoot the intended target and be inefficient. That is, to meet peak demands, the plant operator of FIG. 2 has to activate the two additional LP turbines (i.e., the two that make up the dual-flow LP turbine 108), whereas the plant operator of FIG. 1 has the option of activating a single-flow LP turbine 110. As such, in cases where only a single additional LP turbine is required, the power plant 100 of FIG. 1 is much more efficient and cost-effective. As discussed above, though, the unbalanced single-flow LP turbine 110 has shortcomings of its own in that it requires a costly thrust bearing 116 to balance thrust forces.

Figure 3:
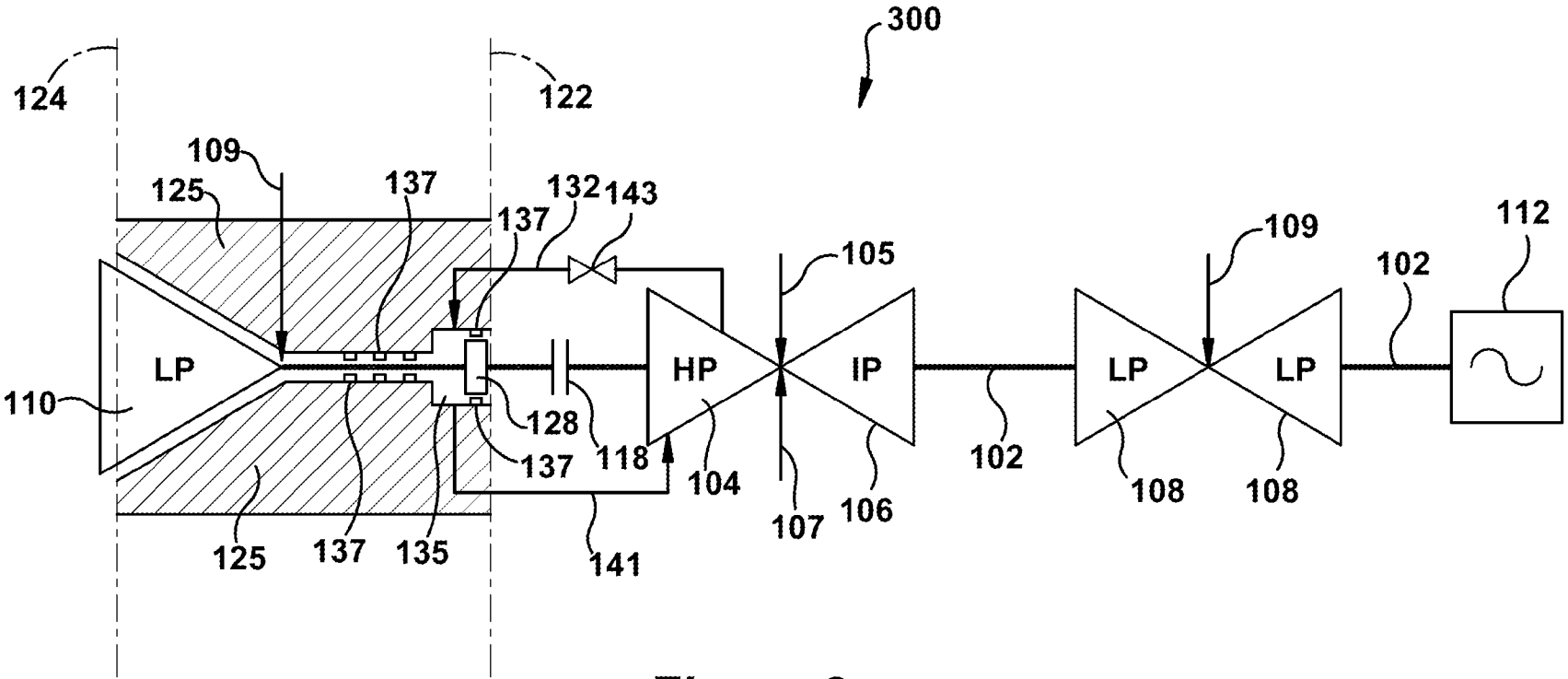
FIG. 3 is a schematic representation of a steam turbine power plant according to an exemplary embodiment of the present application.

FIG. 3 provides a schematic representation of a steam turbine power plant 300 according to an exemplary embodiment of the present application. It will be appreciated that the steam turbine power plant 300 includes the same steam turbines as those shown in the steam turbine power plant 100 of FIG. 1: a HP turbine 104, which includes a high-pressure steam feed 105, an IP turbine 106, which includes an intermediate-pressure steam feed 107, and three LP turbines 108, 110, including two dual-flow LP turbines 108 and a single-flow LP turbine 110. Each of the LP turbine 108, 110 may include a low-pressure steam feed 109, as shown. In addition, similar to the power plant of FIG. 1, the HP turbine 104 is paired (and generally balanced) with the IP turbine 106, and the two dual-flow LP turbines 108 are paired (and generally balanced) with each other so that the thrust each applies to the shaft balances the thrust of the other engine.

The single-flow LP turbine 110, however, cannot be balanced by another turbine. It will be appreciated that when the single-flow LP turbine 110 is operating, it applies a considerable thrust force along the shaft 102 that must be accounted for or balanced in some way.

Note that, between a dashed reference line 122 and a dashed reference line 124, FIG. 3 includes a schematic representation of the stationary turbine casing or outer structure 125 that surrounds the rotor train in that location. This depiction is provided in that section of the power plant 300 because it is particularly illustrative of the present invention. It will be appreciated that the outer structure 125 represents conventional components and structures known in the art.

Pursuant to embodiments of the present application, as depicted in FIG. 3, the thrust of the single-flow LP turbine 110 is balanced or, at least, partially balanced, by a thrust piston 128 against which high-pressure steam is applied. In particular, high-pressure steam acting on a thrust piston 128 that is disposed in proximity to and forward of the single-flow LP turbine 110 compensates, or, at least, partially compensates, for the thrust imbalance produced by the single-flow LP turbine 110 when the single-flow LP turbine 110 is operating and engaged. In general, the thrust piston 128 may comprise a rigid section of the shaft that is enlarged, i.e., has a larger diameter than the shaft 102. Generally, the thrust piston 128 comprises the cylindrical shape, the axis of which is aligned with the axis of the shaft 102. In addition, the cylinder generally comprises a relatively narrow axial thickness and a circular cross-sectional area that may be sized based on the particular application, as described in more detail below. The thrust piston 128 generally will be constructed from conventional materials.

The high-pressure steam that is applied to the thrust piston 128 for this purpose may be extracted per conventional means from the HP turbine 104. From the extraction point, the supply of high-pressure steam may be directed via a first conduit 132 from the HP turbine 104 to a cavity 135. The cavity 135 is a substantially enclosed space that is disposed between the thrust piston 128 and the single-flow LP turbine 110. In the direction of the single flow LP turbine 110, the cavity 135 is bound by stationary structure 125 and a plurality of seals 137 that form a seal between the stationary structure 125 and the shaft 102. The seals 137 may comprise conventional seals that operate to provide a seal between stationary components, which in this case is the stationary structure 125, and rotating components, which in this case is the shaft 102. For example, the seals 137 may be brush seals, hi-lo seals, or other types of seals. In the opposite direction (i.e., in the direction away from the single-flow LP turbine 110), the cavity 135 may be adjacent to and bound by the thrust piston 128 and seals 137 that form a seal between the stationary structure 125 and the thrust piston 128. As before, the seals 137 may comprise conventional seals that operate to provide a seal between stationary components, which in this case is the stationary structure 125, and rotating components, which in this case is the outer radial edge of the cylindrical thrust piston 128.

In some embodiments, as shown in FIG. 3, a second conduit 141 returns the pressurized steam from the cavity 135 to the downstream stages of the HP turbine 104. Thereby returned, the steam may be exhausted into the later stages of the HP turbine 104. This configuration may limit the loss of steam to the system. The steam from cavity 135 may be used for other purposes also. For example, it may be supplied to the IP turbine or one of the LP turbines, or used in a heating system.

A clutch 118 may be provided so that the single-flow LP turbine 110 may be engaged when needed and disengaged when load demands are adequately satisfied by the other available turbines of the power plant 300. When the single-flow LP turbine 110 is disengaged, it will be appreciated there is no net thrust to balance. Thus, the high-pressure steam supply from the HP turbine 104 may be shut-off, which makes the steam that would have been extracted available to the HP turbine 104. The shut-off of the high-pressure steam may be done via a valve 143 or other conventional methods.

When the single-flow LP turbine 110 is engaged, the need for a large, expensive thrust bearing is overcome by applying high-pressure steam against the thrust piston 128 so that the system is balanced. It will be appreciated that by using high-pressure steam as proposed herein, the thrust piston 128 required to balance the single-flow LP turbine 110 may remain relatively compact in size. More particularly, it will be understood that the size of the thrust piston 128 that is required to balance the single-flow LP turbine 110 is dependent upon the pressure of the steam that is supplied to the cavity 135. A lower-pressure supply of steam requires a thrust piston 128 having considerable surface area against which the steam may exert its force. On the other hand, a higher-pressure supply of steam requires less surface area against which to push, while still balancing the thrust force of the single-flow LP turbine 110. The extraction of the steam from the HP turbine 104, as proposed herein, provides the high-pressure supply of steam that allows a relatively small, cost-effective thrust piston 128 to balance the single-flow LP turbine 110. In some embodiments, a known, convenient extraction point within the HP turbine 104 may available and the thrust piston 128 designed to accommodate that particular extraction point. That is, given the pressure of the steam that may be provided to the cavity 135 from the extraction point and the thrust force of the single-flow LP turbine 110 for which compensation is required, the thrust piston 128 may be designed so that necessary surface area is available. Generally, this would require adjusting the diameter of the thrust piston 128 so that it has a desired surface area. In other embodiments, the thrust piston 128 may be designed based on other criteria or limitations and the steam extraction point determined based on it. That is, given the thrust force for which compensation is required and the surface area of the thrust piston 128, an extraction location within the HP turbine 104 may be determined which provides steam at the desired pressure to the cavity 135.

It should be understood that in certain embodiments of the present application, the thrust piston 128 also may be configured so that it balances only a portion of the thrust force created by the single-flow LP turbine 110. In such embodiments, the thrust piston 128 may be configured to partially balance the thrust of the single-flow LP turbine 110 while thrust bearings 116 are included to provide balance to the system. In these cases, it will be appreciated that the size of the thrust bearings 116 likely would be much reduced, which may make this an attractive alternative in certain applications.

In one preferred embodiment, the single-flow LP turbine 110 may be connected to the shaft 102 adjacent to or near the exhaust of the HP turbine 104, while the dual-flow LP section is connected to the rotor train adjacent to the exhaust of the IP turbine 106, as depicted in FIG. 3. However, this application is exemplary only. It will be appreciated that the same principles may be used to balance the thrust of turbines in other types of power plant configurations. For example, the principles provided herein may be used effectively to provide balance to any steam turbine (low pressure or otherwise) in a system that includes a steam turbine that operates at a higher pressure or has another supply of higher pressured steam.

In operation, it will be understood that steam may be extracted from the HP turbine 104 and directed via the conduit 132 to the cavity 135. Within the cavity 135, the pressurized steam asserts an axially aligned force in both directions. In the direction toward the single-flow LP turbine 110, the steam primarily presses against the stationary structure 125. (A small portion of the steam presses against the seal 137 and a smaller portion escapes through the seals 137. The system is configured such that the steam that escapes through the seals 137 enters the single-flow LP turbine 110 where it may be used.) In the direction away from the single-flow LP turbine 110, the steam within the cavity 135 presses primarily on the thrust piston 128. It will be appreciated that the net effect of the pressure with the cavity 135 is a thrust force being applied on the shaft 102 away from the single-flow LP turbine 110. The size of this net force may be configured by varying the surface area of the thrust piston 128 so that a desired portion of the thrust force created by the single-flow LP 110 turbine is counteracted.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations are not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. In a steam turbine power plant that includes a rotor train comprising a high-pressure turbine, an intermediate-pressure turbine, and three low-pressure turbines, wherein the three low-pressure turbines include two that comprise a dual-flow low-pressure turbine and a single-flow low-pressure turbine; wherein the high-pressure turbine and the intermediate-pressure turbine are configured such that each substantially balances the thrust force of the other, and wherein the two low-pressure turbines of the dual-flow low-pressure turbine are configured such that each substantially balances the thrust force of the other; and wherein means for extraction of a supply of high-pressure steam from the high-pressure turbine to a cavity disposed forward of the single-flow low-pressure turbine; and wherein the cavity, in the direction toward the single-flow low pressure turbine, is substantially bound by stationary structure that surrounds a shaft of the rotor train; a thrust piston connected to the shaft, wherein the cavity, in the direction away from the single-flow low pressure turbine, is substantially bound by the thrust piston; and wherein the thrust piston is configured to counteract a desired amount of a thrust force generated by the single-flow low-pressure turbine during operation.

2. The thrust piston according to claim 1, wherein the thrust piston is configured to counteract substantially all of the thrust force generated by the single-flow low-pressure turbine during operation.

3. The thrust piston according to claim 2, wherein a surface area of the thrust piston that bounds the cavity is configured to comprise a size required to counteract substantially all of the thrust force generated by the single-flow low-pressure given the pressure of the high pressure steam that is supplied to the cavity.

4. The thrust piston according to claim 2, wherein the means for extraction comprises an extraction point in the high-pressure steam turbine that provides high-pressure steam to the cavity at a pressure sufficient to counteract substantially all of the thrust force generated by the single-flow low-pressure given a size of the surface area of the thrust piston that bounds the cavity.

5. The thrust piston according to claim 1, wherein the single-flow low-pressure turbine comprises a position adjacent to the exhaust of the high-pressure turbine and the dual-flow low-pressure turbine comprises a position adjacent to the exhaust of the intermediate pressure turbine.

6. The thrust piston according to claim 1, wherein the thrust piston comprises a rigid section of the shaft that comprises a larger diameter than the shaft.

7. The thrust piston according to claim 1, wherein the thrust piston comprises the cylindrical shape, the axis of which is aligned with the axis of the shaft.

8. The thrust piston according to claim 7, wherein the thrust piston comprises a relatively narrow axial thickness and a predetermined circular cross-sectional area.

9. The thrust piston according to claim 8, wherein the predetermined circular cross-sectional area comprises a cross-section area required given the desired thrust force to counteract and the pressure level of the high-pressure steam delivered to the cavity.

10. The thrust piston according to claim 1, wherein the means for extraction comprises a first conduit that is configured to extract high-pressure steam from a predetermined stage of the high-pressure turbine.

11. The thrust piston according to claim 10, wherein a second conduit is configured to direct the high-pressurized steam from the cavity to an aft stage of the high-pressure turbine, the aft stage comprising a stage that is downstream relative to the predetermined stage where high-pressure steam is extracted.

12. The thrust piston according to claim 10, wherein a second conduit is configured to direct the high-pressurized steam from the cavity to the intermediate-pressure turbine.

13. The thrust piston according to claim 10, wherein a second conduit is configured to direct the high-pressurized steam from the cavity to one of the three low-pressure turbines.

14. The thrust piston according to claim 1, wherein:

the cavity, in the direction toward the single-flow low pressure turbine, is further bound by a first plurality of seals, the first plurality of seals being configured to provide a seal between the stationary structure and the shaft; and the cavity, in the direction away from the single-flow low pressure turbine, is further bound by a second plurality of seals, the second plurality of seals being configured to provide a seal between the stationary structure and the thrust piston.

15. The thrust piston according to claim 1, wherein the shaft includes a clutch that operates to desirably engage and disengaged the single-flow low-pressure turbine from the rotor train.

16. The thrust piston according to claim 1, wherein:

when the single-flow low-pressure turbine is engaged by the clutch, the means for extraction operates to supply the high-pressured steam from the high-pressure turbine to the cavity; and when the single-flow low-pressure turbine is disengaged by the clutch, the means for extraction discontinues to supply the high-pressured steam from the high-pressure turbine to the cavity.

* * * * *

UNITED STATES PATENT AND TRADEMARK OFFICE

CERTIFICATE OF CORRECTION

PATENT NO. : 8,425,180 B2
APPLICATION NO. : 12/650848
DATED : April 23, 2013
INVENTOR(S) : Sears et al.

It is certified that error appears in the above-identified patent and that said Letters Patent is hereby corrected as shown below:

In the Specification

In Column 1, Line 44, delete "pan-time" and insert -- part-time --, therefor.

In Column 4, Line 32, delete "11R" and insert -- 118 --, therefor.

In Column 4, Line 45, delete "system's," and insert -- systems, --, therefor.

Signed and Sealed this
Eleventh Day of June, 2013

Teresa Stanek Rea

Teresa Stanek Rea
*Acting Director of the United States Patent and Trademark Office*